United States Patent [19]

Ong S.T.

[11] Patent Number: 4,869,703

[45] Date of Patent: Sep. 26, 1989

[54] DRIVING MECHANISM FOR AN ANIMATED TOY

[76] Inventor: Raymond Ong S.T., Fl. 7-1, No. 149, Kee Lung Road, Section 1, Taipei, Taiwan

[21] Appl. No.: 140,692

[22] Filed: Jan. 4, 1988

[51] Int. Cl.[4] ..... A63H 13/02

[52] U.S. Cl. ..... 446/353; 446/330; 446/354; 446/301; 40/414

[58] Field of Search ..... 272/1 R, 52, 52.5, 48; 446/301, 330, 337, 338, 352, 353, 354, 298, 300; 40/456, 470, 411, 416, 417, 419, 420

[56] References Cited

U.S. PATENT DOCUMENTS

| | | | |
|---|---|---|---|
| 637,508 | 11/1899 | Grimoin-Sanson et al. | 272/48 |
| 1,503,735 | 8/1924 | Williams | 446/352 X |
| 1,542,542 | 6/1925 | Echevarria | 40/456 X |
| 1,685,358 | 9/1928 | Harcourt | 40/411 X |
| 1,796,991 | 3/1931 | Harpham | 40/419 X |
| 2,570,778 | 10/1951 | De Vane | 446/354 X |
| 2,859,554 | 11/1958 | Walss | 446/353 |
| 3,153,871 | 10/1964 | Semba | 446/353 X |
| 3,456,383 | 7/1969 | Gardel et al. | 446/353 |
| 4,266,367 | 5/1981 | Kuna et al. | 446/354 X |
| 4,571,209 | 2/1986 | Manning et al. | 446/376 X |

FOREIGN PATENT DOCUMENTS

| | | | |
|---|---|---|---|
| 2154890A | 9/1985 | United Kingdom | 446/353 |
| 2188851A | 10/1987 | United Kingdom | 446/353 |

*Primary Examiner*—Robert A. Hafer
*Assistant Examiner*—Sam Rimell
*Attorney, Agent, or Firm*—Varndell Legal Group

[57] ABSTRACT

A driving mechanism for an animated toy includes a head having a movable mouth, a plurality of shafts having first ends and second ends connected to the limb and the head of the toy, a driving body securing thereon the shafts and a motor, an oscillating piece rotatably attached to the driving body and having a top hole engaging therin one of the first ends, a plurality of side holes each of which is capable of engaging therein another first end and a bottom hole, and a driving piece driven by the motor and having a protrusion which is eccentrical to the shaft of the motor and engages in the bottom hole such that when the motor is energized, the protrusion will oscillate the oscillating piece and in turn oscillate the shafts which in turn oscillate the limb and the head.

9 Claims, 4 Drawing Sheets

DRIVING MECHANISM FOR AN ANIMATED TOY

BACKGROUND OF THE INVENTION

The present invention relates to an animated toy and, more particularly, to a driving mechanism for an antimated toy.

Toys in present days are not idle but are devised to be animated more and more and therefore the driving mechanism for these more animated toys is desired to be more complicated. The key element in present toys is the gear. Normally, a toy having an oscillating head and oscillating arms calls for various kinds of reduction gears and transmission gears of various sizes. Not only does the driving mechanism have a complicated structure, but also it has a high cost and a low production rate. In order to overcome these problems, someone has designed a toy of the so-called frame-wire transmission type, i.e. respective frame wires are used to define the oscillation of respective head and hands of the toy. Although such toy has a simplified structure and a relatively higher production rate, to manufacture and assemble them is still time-consuming. Furthermore, it is difficult to control the oscillating amplitude of the head and hands with the frame wires. In addition, the bulk of the toy body must be relatively large in order to install the respective frame wires therein.

Therefore, the applicant has attempted to resolve the above situation encountered by the prior art.

SUMMARY OF THE INVENTION

According to the present invention, a driving mechanism for an animated toy includes a head having a movable mouth, a plurality of shafts connected to the limb and the head, a driving body securing the shafts and a motor, an oscillating piece rotatably attached to the driving body and having a top hole engaging one shaft end, a plurality of side holes each of which an engage another shaft end and a bottom hole, and a driving piece driven by the motor and having a protrusion which is eccentric to the shaft of the motor and which engages the bottom hole such that when the motor is energized, the protrusion will oscillate the oscillating piece and which in turn will oscillate the shafts and which in turn oscillate the limb and the head of the toy.

It is therefore an object of the present invention to provide a driving mechanism for an animated toy having a more simplified structure and a higher production rate and which is capable of easy assembly.

It is therefore another object of the present invention to p rovide a driving mechanism for an animated toy capable of controlling the oscillating amplitude of the limb of the toy.

It is further an object of the present invention to provide a driving mechanism for an animated toy having a relatively narrow intermediate portion and a relatively broad lower portion simulating the profile of a human figure, which permits miniaturization of the toy to a significant extent.

It is yet an object of the present invention to provide a driving mechanism for an animated toy further including a connecting piece connected to the bottom thereof and having a bottom hole so that the toy can be placed on any place having a projection engagable into the bottom hole of the connecting piece.

These and other objects of the present invention may best be understood through the following description with reference to the accompanying drawings, in which:

DETAILED DESCRIPTION OF THE PREFERRED EMBODIMENT

Figure 1:
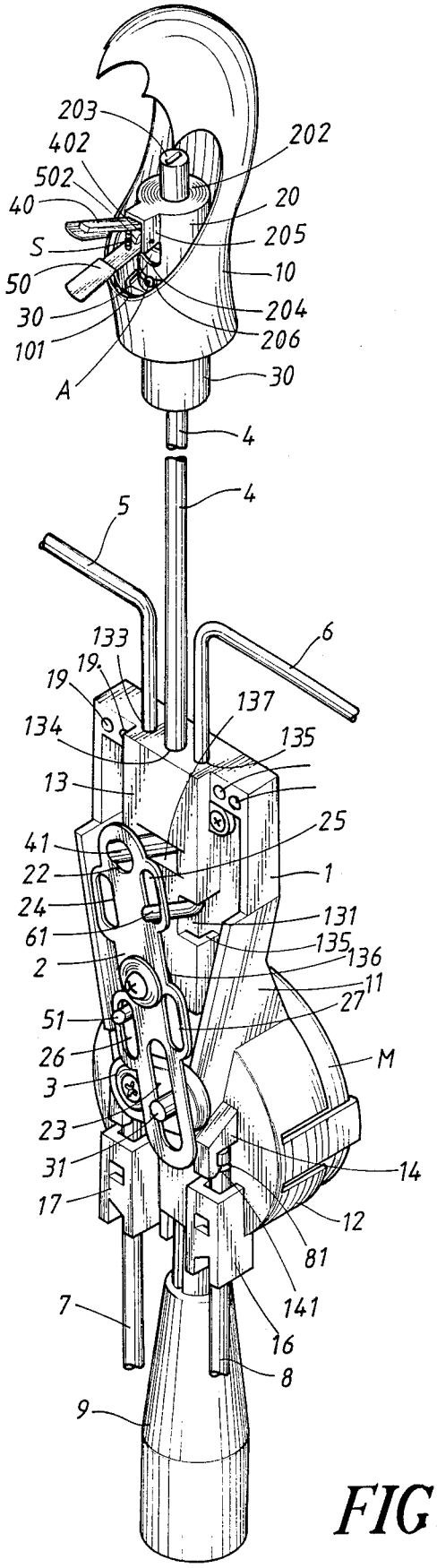
FIG. 1 is a perspective view showing a driving mechanism for an animated toy according to the present invention.
Figure 2:
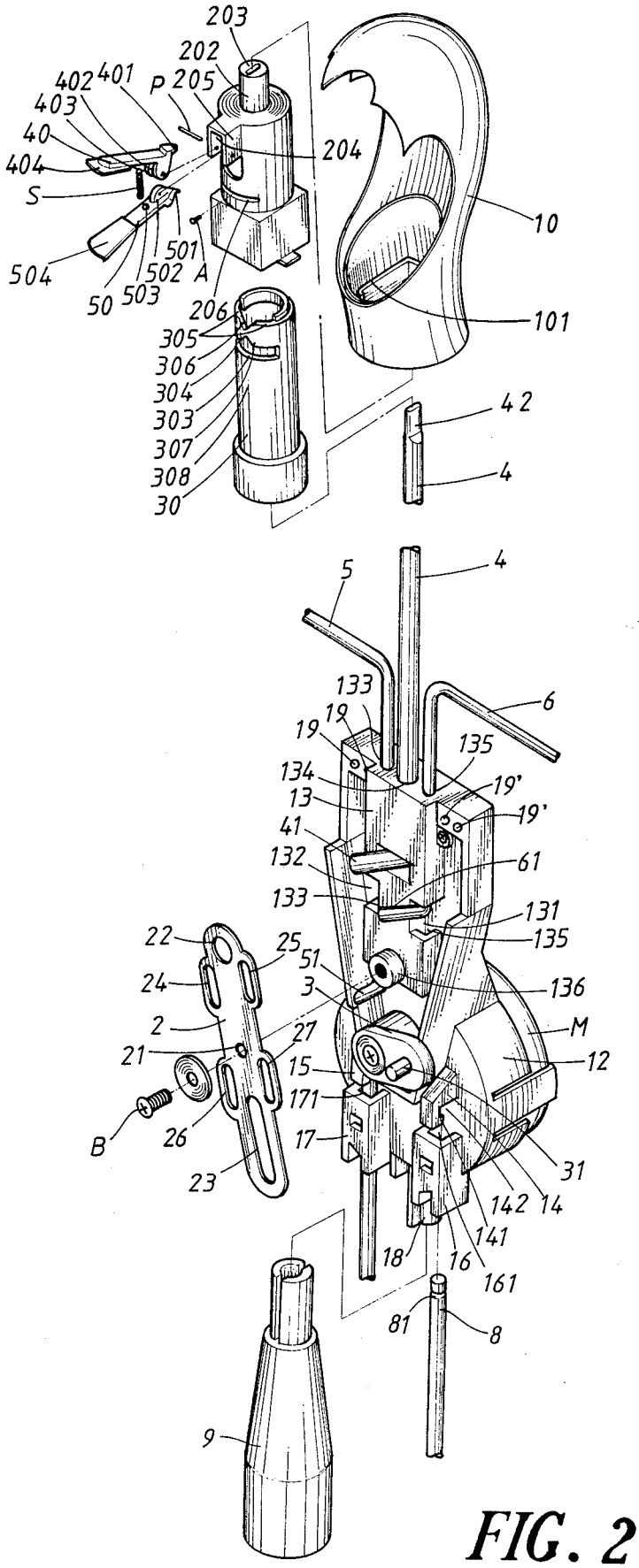
FIG. 2 is an exploded view showing a driving mechanism for an animated toy according to the present invention.

Referring now to FIGS. 1 and 2, there is shown a preferred embodiment of a driving mechanism for an animated toy according to the present invention including a driving body 1 which can be produced by mould injection in one piece the driving body 1 has a relarively narrow intermediate (waist) portion 11 with a positioning stud 136 and a screw hole; a relatively broad; lower portion 12 for installing therein a motor M; and has an upper portion 13 which includes three holes 131, 132, 137 and three vertical holes 133–135. Lower portion 12 further includes two elastic hooks 14, 15 and respectively two retaining blocks 16, 17, each having a hole passing therethrough, positioned respectively beneath hooks 14, 15 and respectively having two through holes 161, 171 communicating with hooks 142 respectively.

A driving mechanism for an animated toy according to the present invention further includes a head, a plurality of shafts 4, 5, 6 having first bent ends 41, 51, 61 protruding from holes 137, 132, 131 respectively and second ends being respectively connected to the limb (e.g. arms) and the head of the toy (e.g. a doll), an oscillating piece 2, a driving piece 3 driven by motor M and having a protrusion 31 eccentrical to the shaft of motor M, and two leg shafts 7, 8.

Oscillating piece 2 has a central hole 21 through which a bolt B threads into the screw hole of stud 136 so as to be rotatably attached to driving body 1. Oscillating piece 2 can also be formed in one piece (i.e., each parts thereof are integrally formed together) and includes a top hole 22 engaging bent end 41, a plurality of side holes 24 and 26 and 25 and 27 respectively and selectively engaging bent ends 51 and 61, and a bottom hole 23 engaging protrusion 31.

Driving body 1 rotatably secures shafts 4–6 in holes 133–135 respectively. In dependence upon the desired oscillating amplitude of the limbs, bent ends 51, 61 can, through horizontal holes 132, 131 respectively, respectively engage in one of side holes 24 and 26 and one of side holes 25 and 27. Alternatively the toy can be designed to only permit one of its limbs to oscillate. At this time, the inoperative shaft 5, 6 can have its bents end 51, 61 inserted in one of positioning holes 19, 19' provided on driving body 1.

The top ends of leg shafts 7, 8 can be provided with annular grooves 81 by which when leg shafts 7, 8 are inserted through retaining blocks 17, 16 respectively to urge against and pass through hook points 141, hook points 141 will engage in grooves 81 and hook top ends of leg shafts 7, 8 in hooking rooms 142. If leg shafts 7, 8 are to be detached from hooking rooms 142, one only needs to pull against hook points 141 to allow them to escape therefrom.

A connecting piece 9 can be connected to the bottom 18 of driving body 1 and have a bottom hole by which the present toy can be fixed to any place having a protrusion engagible in the bottom hole of piece 9.

Figure 3:
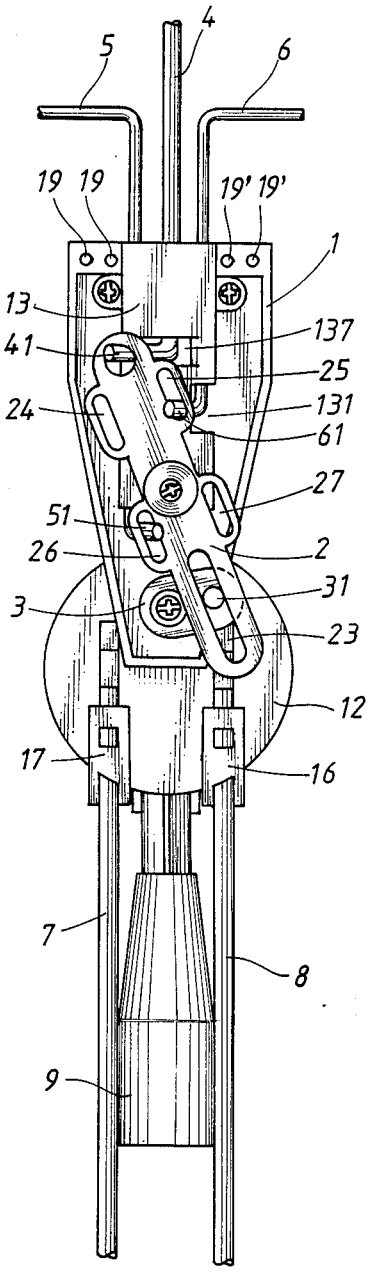
FIG. 3 is a front view showing an oscillating piece of a driving mechanism for an animated toy according to the present invention in its most leftward position.
Figure 4:
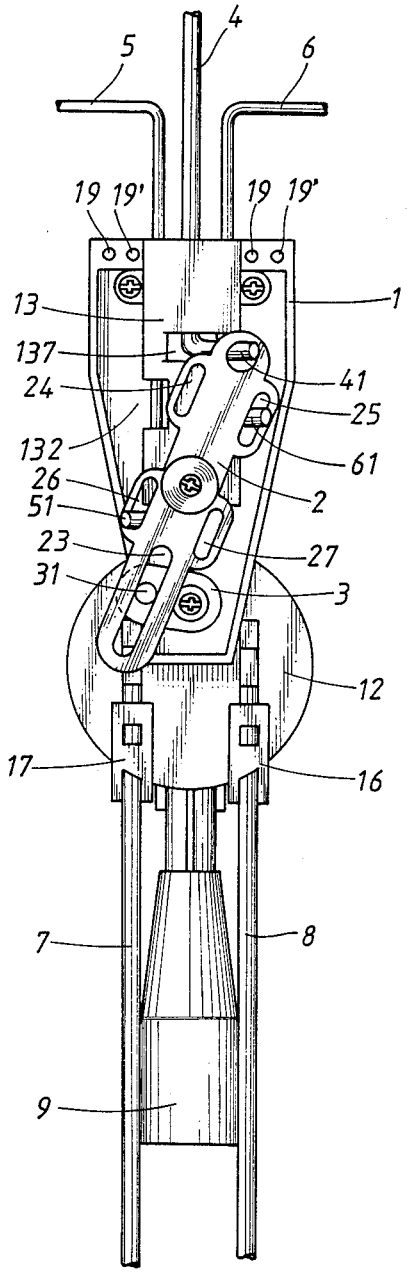
FIG. 4 is a front view showing the oscillating piece in FIG. 3 in its most rightward position.
Figure 5:
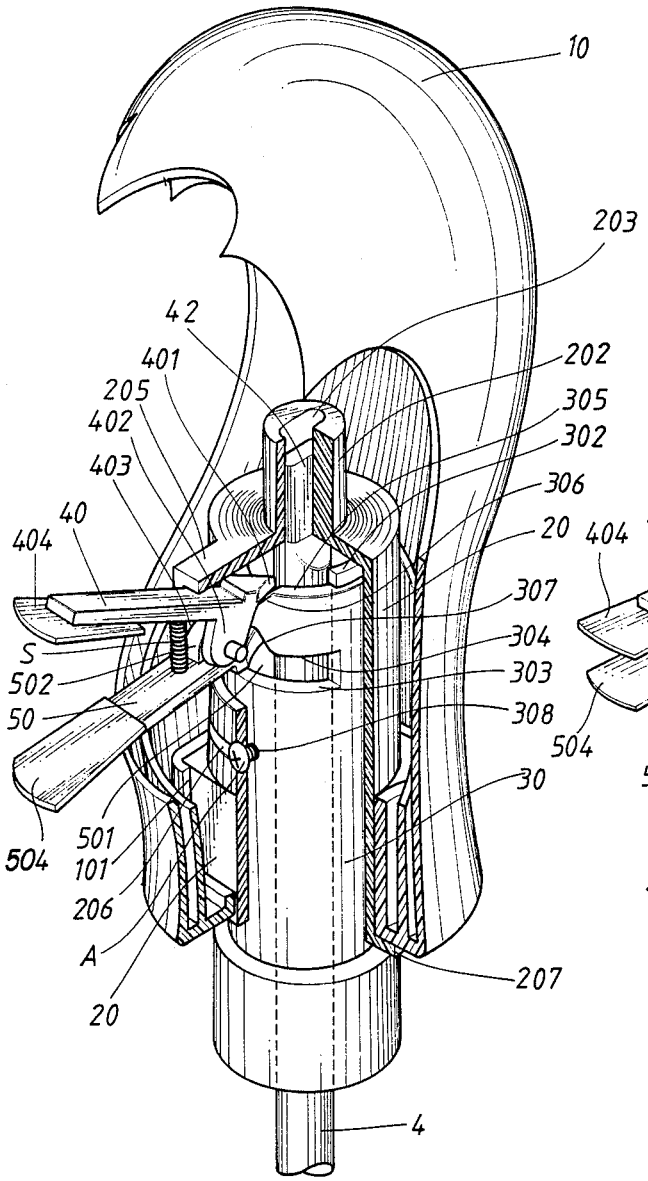
FIG. 5 is a fragmentarily sectional view showing a head of a driving mechanism for an animated toy according to the present invention.
Figure 6:
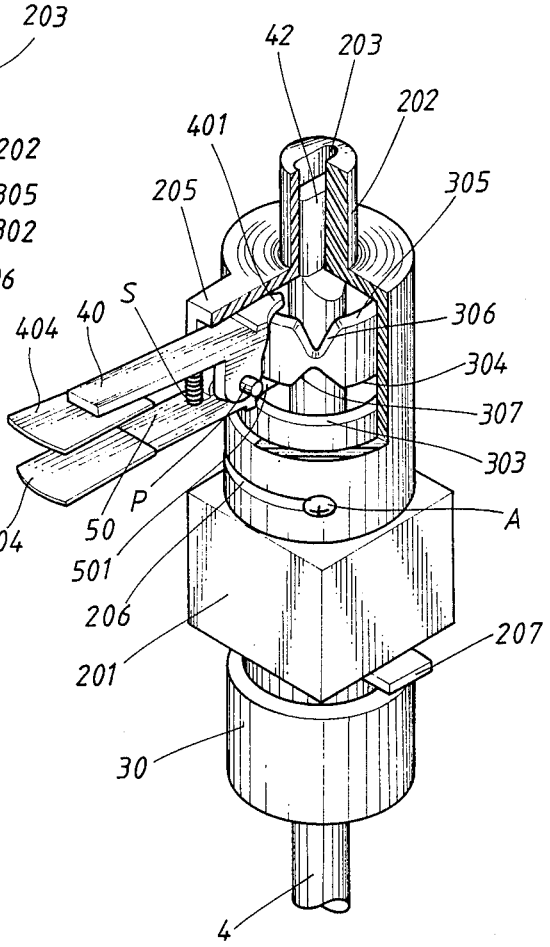
FIG. 6 is a schematic view showing two mouth pieces of a driving mechanism for an animated toy according to the present invention in contact.

Referring now to FIGS. 3 and 4, when motor M is energized, protrusion 31 will oscillate oscillating piece 2 and in turn oscillate shafts 4, 5, 6 which in turn oscillate the head and the limb or limbs of the toy. Since side holes 24–27 do not have an equal distance to the shaft of motor M, side holes 24 and 25 should be selected to engage therein bent ends 51 and 61 if larger oscillating amplitude of shafts 5 and 6 is desired since they have a larger distance to the motor shaft.

Referring now to FIGS. 1, 2, 5, 6, the head for a driving mechanism for an animated toy according to the present invention includes a housing 10 having a square hole 101, an oscillating sleeve 20, a positioning sleeve 30 and two mouth pieces 40, 50. Oscillating sleeve 20 has a bottom square block 201 received in square hole 101, a top protrusion 202 having a through groove 203 fixing therein the top end 42 of shaft 4, an upper opening 204, an extension 205 integrally formed to the upper wall of opening 204, a lower radial groove 206, and two bottom extensions 207.

Positioning sleeve 30 fixed to driving body 1 (the manner of which is not shown) is recieved in oscillating sleeve 20 and has a top rim 302 having a first surface 305 and a second indented surface 306, and a groove 301 having an upper wall having a first surface 304 and a second indented surface 307 which corresponds to and is positioned right beneath second indented surface 306.

A screw marked A (as shown in FIG. 2) screws through radial groove 206 into a screw hole 308 provided on positioning sleeve 30 so that oscillating sleeve 20 can oscillate with respect to positioning sleeve 30 within the range defined by radial groove 206 and screw A.

Two mouth pieces 40, 50 pivotally mounted together on extension 205 by a pin P which is inserted through extension mount 205, lug 402 on piece 40, a lug 502 and lug 403 extension 205 mount, a compression spring S is provided having two ends attached to two protuberances 403, 503 respectively provided on pieces 40, 50. First ends 401, 501 of pieces 40, 50 respectively engaging top rim 302 and the upper wall of groove 301 such that when sleeves 20, 30 are set in relative oscillation, i.e., motor M is energized, the second opposite ends 404, 504 of pieces 40, 50 will be periodically drawn near nearer or further apart when first ends 401, 501 respectively engage first surfaces 305, 304 and second indented surface 306, 307.

More specifically, when sleeves 20, 30 are in a relative position which rests first ends 401, 501 respectively on first surfaces 305, 304, mouth pieces 40, 50 will be drawn closer to each other, while they will be further apart when sleeves 20, 30 are in a relative position nesting first ends 401, 501 respectively on second indented surfaces 306, 307. Since motor M will periodically oscillate oscillating sleeve 20 with respect to positioning sleeve 30, second opposite ends 404, 504 of pieces 40, 50 will be periodically drawn closer and the pushed apart.

Through the above description, one can realize now why and how a driving body for an animated toy according to the present invention can have a simplified manufacturing and assembly, can achieve the objects of high production rate and low cost, and can achieve numerous functions and other objects above described or become apparent through the description hereinbefore.

What I claim is:

1. A driving mechanism for an animated toy comprising:

a head and a limb;

a plurality of rotatable shafts having first ends and second ends adapted to be respectively connected to the said limb and said head of said toy;

a driving body having holes rotatably securing said shafts therein and being adapted to a secure a motor therein;

an oscillating piece pivoted to said driving body said oscillating piece having a top hole engaging one of said first ends of said shafts, a plurality of side holes each of which is capable of engaging another said first end of said shafts, and a bottom hole; and a driving piece driven by a shaft of said motor and having a protrusion which is eccentric to said shaft of said motor and which engages in said bottom hole such that when said motor is energized, said protrusion will oscillate said oscillating piece causing said shafts to rotate within said driving body thereby causing said limb and said head to oscillate.

2. A driving mechanism for an animated toy as claimed in claim 1 wherein said head includes:

a housing;

a oscillating sleeve fixed to said housing, attached thereto the shaft having said one first end and having an upper opening and a lower radial groove;

a positioning sleeve fixed to said driving body, received in said oscillating sleeve, and having a top rim having a first surface and a second indented surface, and a groove having an upper wall having a first surface and a second indented surface which is positioned beneath and corresponds to said second indented surface of said top rim; a screw screwing through said lower radial groove into said positioning sleeve so that said oscillating sleeve can oscillating with respect to said positioning sleeve; and two mouth pieces pivotally mounted on said upper opening and having first ends respectively engaging said top rim and said upper wall such that when said sleeves are set in relative oscillation, the second opposite ends of said two mouth pieces will be periodically drawn closer and farther apart when said first ends thereof respectively engage said first surfaces and said second indented surfaces.

3. A driving mechanism for an animated toy as claimed in claim 1 wherein said driving body is produced by mould injection in one piece.

4. A driving mechanism for an animated toy as claimed in claim 1 wherein at least two of said plurality of shafts have a second end connect to said limb, one of said shafts having a first end engaging one of said pluality of side holes, and another of said shafts having a first end engaging one of a plurality of positioning holes for providing a stationary limb.

5. A driving mechanism for an animated toy as claimed in claim 1 wherein said driving body has a relatively narrow intermediate portion and a relatively broad lower portion for installing therein said motor.

6. A driving mechanism for an animated toy as claimed in claim 1, further comprising a connecting piece connected to the bottom of said driving body and having a bottom hole for connecting the animated toy to an external object- 7. A driving mechanism for an animated toy as claimed in claim 1, wherein said driving body further includes two elastic hooks and two retaining blocks positioned beneath respectively said two hooks for securing leg chaps thereto.

8. A driving mechanism for an animated toy as claimed in claim 7, further comprising two leg shafts for providing support to the animated toy, each of which has an annularly grooved top and passing through one of said retaining blocks and hooked by one of said hooks.

9. A driving mechanism for an animated toy as claimed in claim 1, wherein said plurality of side holes are arranged so that each side hole has a different distance to the shaft of the motor.

* * * * *